US005738174A

United States Patent [19]

Sundholm

[11] Patent Number: 5,738,174

[45] Date of Patent: Apr. 14, 1998

[54] GAS-DRIVEN METHOD FOR FIGHTING FIRE

[76] Inventor: Göran Sundholm, Ilmari Kiannon kuja 3, FIN-04310 Tuusula, Finland

[21] Appl. No.: 605,108

[22] PCT Filed: Sep. 12, 1994

[86] PCT No.: PCT/FI94/00400

§ 371 Date: Feb. 29, 1996

§ 102(e) Date: Feb. 29, 1996

[87] PCT Pub. No.: WO95/07116

PCT Pub. Date: Mar. 16, 1995

[30] Foreign Application Priority Data

Sep. 10, 1993 [FI] Finland ..... 933997

[51] Int. Cl.[6] ..... A62C 3/10

[52] U.S. Cl. ..... 169/46; 169/9; 169/13; 169/62

[58] Field of Search ..... 169/5, 9, 13, 43, 169/46, 47, 60, 62; 417/12, 18; 60/413, 418, 431

[56] References Cited

U.S. PATENT DOCUMENTS 4,224,994 9/1980 Tone et al. ..... 169/9

FOREIGN PATENT DOCUMENTS

92/22353 12/1992 WIPO .

93/10859 6/1993 WIPO .

*Primary Examiner*—Andrew C. Pike

*Attorney, Agent, or Firm*—Ladas & Parry

[57] ABSTRACT

A method of fighting a fire drives a first fire-extinguishing liquid from at least one spray head or sprinkler at a fire with a low-pressure pump. Thereafter it drives a second fire-extinguishing liquid from a liquid container and the spray head or sprinkler at the fire with a first propellant gas from at least one gas container, at least some of the first propellent gas remaining in the gas container after all of the second fire-extinguishing liquid has been driven from the liquid container. Still thereafter it again drives the first fire-extinguishing liquid from the spray head or sprinkler at the fire with the low-pressure pump, the low-pressure pump being driven by the first propellant gas that was remaining in the gas container.

10 Claims, 2 Drawing Sheets

GAS-DRIVEN METHOD FOR FIGHTING FIRE

The present invention relates to a method for fighting fire, in which method extinguishing liquid is delivered to at least one spray head, preferably a plurality of spray heads, by means of a drive unit comprising at least one hydraulic accumulator containing propellent gas chargeable up to a high initial pressure as well as a low-pressure water pump.

One advantage of using hydraulic accumulators in fire fighting equipments is a reduced dependence on availability of electric current for pump functions requiring energy. The problem is serious especially in ships and units comparable with them, in which the electric main system including the main generator is often put out of function in case of fires, and the emergency generator set, if existing, has an insufficient effect for practically whichever pump functions.

In case hydraulic accumulators are used, efficient fire fighting usually presupposes a high charging pressure, preferably up to 200 to 300 bar, in the hydraulic accumulators. For securing the function of the fire fighting equipment in an intended way, predetermined stages with relatively low driving pressure, e.g., 10 to 30 bar, should preferably also be included in the procedure, however. An example of such a stage is an initial cooling of the pipe system and especially the sprinklers or spray heads which before release have been heated by the fire broken out.

The object of the invention is to attend also to necessary low-pressure functions in a novel way by means of a high-pressure drive unit having one or several hydraulic accumulators, in order to achieve a minimum dependence on availability of electric energy.

The purpose of the invention is mainly that at least part of the propellent gas being left over after the hydraulic accumulators have been emptied of liquid is utilized for driving the low-pressure pump.

A preferred procedure is that at least part of the propellent gas being left over after the hydraulic accumulators have been emptied of liquid is utilized for driving the low-pressure pump, in order to refill the hydraulic accumulators with liquid and to spray simultaneously preferably the seat of fire and its surroundings with liquid and/or propellent gas so that the procedure can be repeated after the hydraulic accumulators have been filled.

Alternatively, it is in many cases of advantage that part of the propellent gas being left over after the hydraulic accumulators have been emptied of liquid is initially allowed to flow directly after the liquid to corresponding sprinklers and/or spray heads and that the remaining propellent gas is then utilized for driving the low-pressure pump, in order to refill the hydraulic accumulators with liquid and to spray simultaneously preferably the seat of fire and its surroundings with liquid and/or propellent gas so that the procedure can be repeated after the hydraulic accumulators have been filled.

According to a further-developed embodiment of the invention, the delivery of high-pressure liquid is delayed initially when the drive unit is switched on, during which delay stage gas is led preferably via a pressure reducing valve to drive the low-pressure pump for delivering cooling liquid to the pipe system and sprinklers and/or spray heads in question, and at least part of the propellent gas being left over after the hydraulic accumulators have been emptied of liquid is utilized for redriving (i.e., again driving) the low-pressure pump.

The delivery of high-pressure liquid is preferably delayed by leading the propellent gas from said at least one hydraulic accumulator to empty a liquid cylinder so that the liquid driven out of the cylinder affects, before passing a throttle, a spindle of a valve arranged in an outlet line of said at least one hydraulic accumulator in a direction closing the valve. Hereby the spindle surface affected by the pressure of said cylinder liquid is larger than the spindle surface affected by the outgoing liquid pressure of said at least one hydraulic accumulator, which pressure strives to open the valve, so that the valve is not opened until all liquid has been driven out of the cylinder and its pressure has sunk over the throttle to a level lower than the outgoing liquid pressure of said at least one hydraulic accumulator in a proportion equal to the proportion between said two spindle surfaces of the valve.

The opening time of the valve can be adjusted by means of said throttle.

Upon opening the valve, the liquid pressure affecting the valve spindle via the throttle is preferably allowed to sink preferably via an overflow valve to a predeterminable value, for adjusting the pressure at which the valve is closed again.

The propellent gas being left over after the hydraulic accumulators have been emptied is preferably utilized for redriving the low-pressure pump in order to refill the hydraulic accumulators with liquid and to spray simultaneously preferably the seat of fire and its surroundings with liquid and/or propellent gas so that the procedure can be repeated after the hydraulic accumulators have been filled.

Particularly in equipments for fighting fires in engine rooms of ships, it is of advantage that part of the propellent gas being left over after the hydraulic accumulators have been emptied is initially allowed to flow directly after the liquid to corresponding sprinklers and/or spray heads and the remaining propellent gas is then utilized for redriving the low-pressure pump in order to refill the hydraulic accumulators with liquid and to spray simultaneously preferably the seat of fire and its surroundings with liquid and/or propellent gas so that the procedure can be repeated after the hydraulic accumulators have been filled.

In engine rooms of ships, it is also desirable that, at least during the initial stage with delayed delivery of high-pressure liquid and during the stage after the hydraulic accumulators have been emptied of liquid, gas, preferably propellent gas, is led from said at least one hydraulic accumulator into a bilge space of the engine room. Gas from a separate source can alternatively be utilized.

All functions described above can be realized, if necessary, without available electric energy. By means of suitable dimensioning, it is possible to carry out an emptying and filling cycle during approximately 2×15 minutes.

In the following, the invention will be described in more detail with reference to preferred embodiments shown in the attached drawing.

Figure 1:
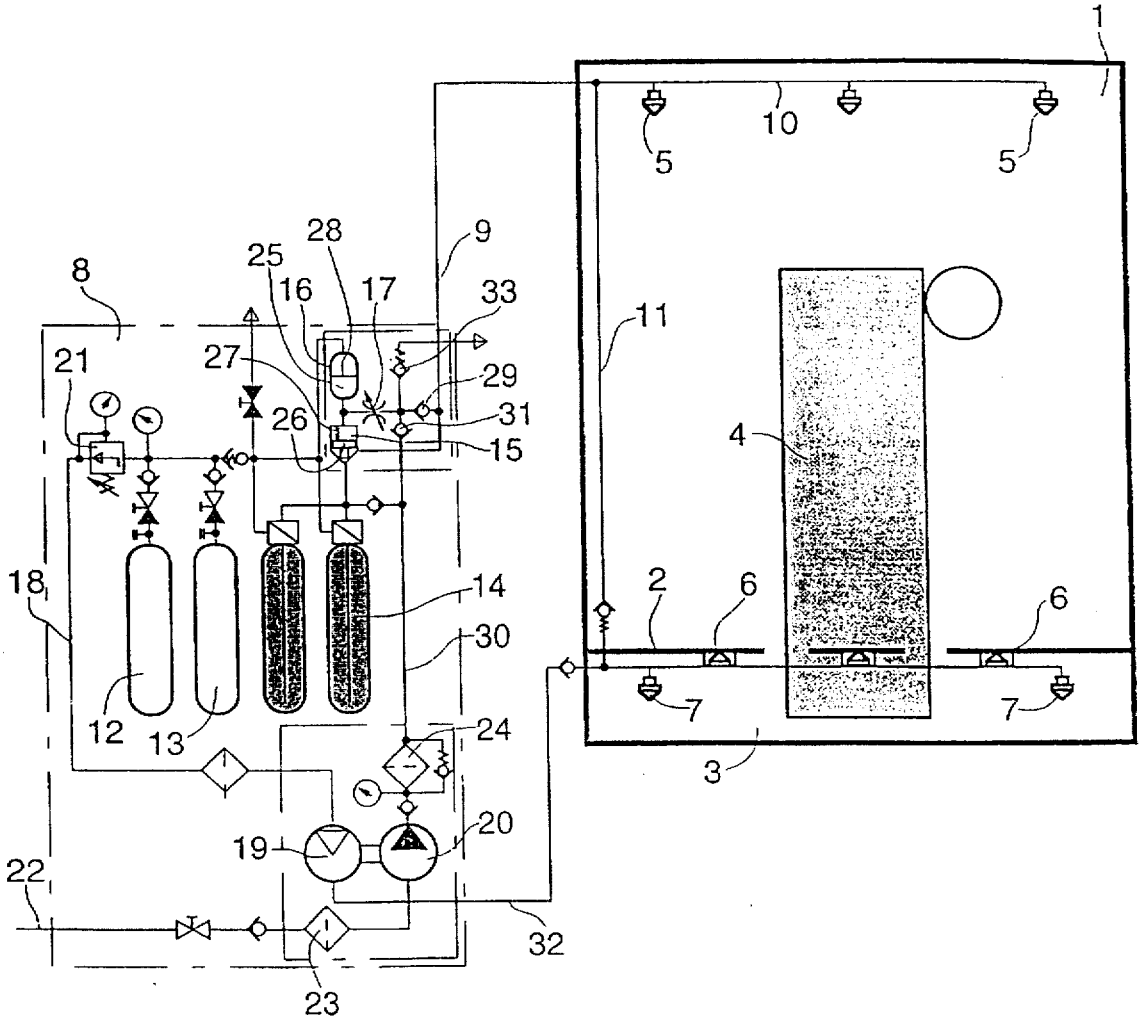
FIG. 1 shows a basic embodiment of a fire fighting equipment according to the invention.

In FIG. 1, an engine room is indicated by reference numeral 1, the floor of the engine room is indicated by 2, a bilge space below the floor is indicated by 3 and the engine in question, e.g., a diesel engine, is indicated by 4. Up to the ceiling of the engine room are positioned a number of sprinklers or spray heads 5 and on the floor level are positioned a number of spray heads and/or sprinklers 6 directed upwards and a number of nozzle heads 7 directed down-wards, into the bilge space 3.

A drive unit for delivering extinguishing liquid and/or extinguishing gas is indicated by 8. An outgoing liquid line 9 of the drive unit 8 can be connected selectively with separate fire zones; the engine room 1 constitutes a fire zone comprising a feederline 10 to the spray heads 5 at the ceiling of the engine room and a branching 11 to the spray heads 6, 7 at the engine room floor 2.

The drive unit 8 comprises two pressure gas containers 12 and 13 having an initial charging pressure of, e.g., 200 bar and automatically or manually controllable outlet valves for leading pressure gas into and driving extinguishing liquid out of two liquid containers 14 through the line 9. The pressure gas containers 12, 13, may be constituted by so-called standard gas bottles. The extinguishing liquid from the containers 14 is arranged to flow into the line 9 via a valve 15, the opening of which effected by the liquid pressure is, however, counteracted by a liquid cylinder 16, arranged in connection with the propellent gas pressure, in combination with a throttle 17, which shall be described in greater detail below.

A common outlet line 18 of the propellent gas containers 12 and 13 is connected, besides to the liquid containers 14, also to a low-pressure water pump 19, 20, where 19 indicates a pneumatic driving motor for the actual water pump 20 having an operating pressure of, e.g., about 16 bar via a pressure reducing valve 21, which may be adjusted for 10 bar. It is alternatively possible to use a low-pressure pump of another type, e.g., a double-acting piston pump. The pump 20 sucks water from a fresh water container via a line 22 or, e.g., sea or lake water, alternatively. The water is filtered by means of filters 23 and 24 to a particle level of 10μ, for instance. Occurring variations in pressure may be balanced by means of an accumulator not shown in FIG. 1.

FIG. 1 shows the equipment ready for being used. The pressure bottles 12 and 13 are filled with propellent gas, having a pressure of, e.g., 200 bar, and the liquid bottles 14 are filled with water, as is the liquid cylinder 16, the filled liquid space of which is indicated by 25. A spring 27, which may be relatively weak, keeps the spindle 26 of the valve 15 in the shown position closing the valve.

When a fire is detected, one of the propellent gas containers, e.g., the container 12, is switched on at first, whereby the gas strives to drive the liquid out of the containers 14 via the valve 15 to the outlet line 9 by pressing up the valve spindle 26 from the position of FIG. 1 under the influence of the liquid pressure.

However, the same gas pressure also acts on a membrane 28 of the liquid cylinder 16, which membrane may also be a piston, and therefore presses the liquid 25 out partly via the throttle 17 and a subsequent nonreturn valve 29 into the line 9, but partly also towards the spindle 26 of the valve 15 against the effect of the liquid pressure from the containers 14. As shown schematically in the drawing, by making the spindle 26 surface affected by the pressure of the cylinder liquid 25 larger than the spindle 26 surface affected by the equally high pressure of the extinguishing liquid of the containers 14, e.g. in the proportion 2,5:1, the valve 15 will remain closed until the liquid 25 has been pressed out of the cylinder 16 entirely and its pressure has subsequently sunk via the throttle 17 to about 40 bar in the present example case, whereby the extinguishing liquid is able to press away the spindle 26 of the valve 15.

During the just-described initial stage, the length of which may be adjusted as desired by means of the throttle 17, the pressure gas drives, however, via the line 18 and the pressure reducing valve 21, the pump 20 delivering liquid via its outlet line 30, having the filter 24 and a nonreturn valve 31 after filler branching to the containers 14, to the outlet line 9 of the drive unit 8 over the nonreturn valves 29 and 31, for an initial cooling of at least the spray heads 5 and the parts of the line 10 which extend in the engine room 1. The pressure of the cylinder liquid 25 after the throttle 17 is lower than the outlet pressure of the pump 20. Additionally, the pneumatic motor 19 can deliver gas via an outlet line 32 to the nozzles 7 in the bilge space 3 of the engine room 1.

Upon opening the valve 15, the driving of the extinguishing liquid out of the containers 14 will begin and the pump 20 stops when the nonreturn valves 29 and 31 are closed. Excess liquid pressed by the valve 15 into the line space around the throttle 17 is allowed to flow out through an overflow valve 33, which may be adjusted for e.g., 16 bar. The gas container 12 and the liquid containers 14 can be dimensioned for instance in such a way that, with the containers 14 emptied of liquid, a gas pressure of about 80 bar prevails in them and in the container 12. Gas will then continue flowing out after the liquid through the line 9 until the pressure has sunk so much that the pressure in the space around the throttle 17 is able to close the valve 15. If the last-mentioned pressure is about 16 bar, the valve 15 is closed at a pressure of about 40 bar in the containers 14, and subsequently the remaining gas in the containers 12 and 14 continues driving the pump 20.

The pump 20 now refills the containers 14 with water. If the overflow valve 33 is adjusted to a value somewhat higher than the outlet pressure of the pump 20, liquid is delivered also to the outlet line 9 exactly in the same way as during the initial stage described previously, and simultaneously the cylinder 16 is refilled with water. When the containers 14 have been filled, the procedure can be repeated by switching on the other pressure gas container 13.

Both during the initial stage and during the liquid filling stage, the pneumatic motor 19 can also deliver propellent gas, say nitrogen or argon gas, via a gas line 32 extending from the motor 19 and via the nozzles 7 to the bilge space 3 of the engine room.

Figure 2:
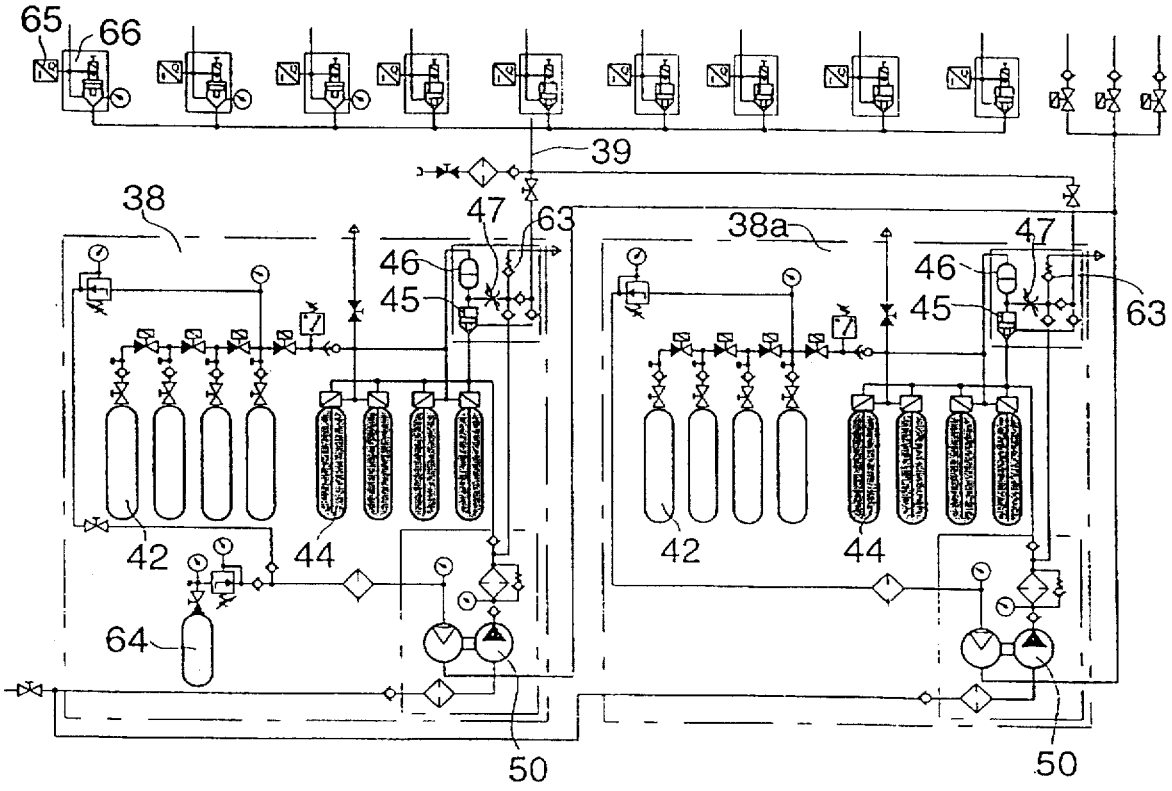
FIG. 2 shows a further-developed embodiment having a higher capacity than the embodiment of FIG. 1.

FIG. 2 shows an embodiment of the invention for a fire fighting equipment having a higher capacity, e.g., a car ferry. FIG. 2 shows two high-pressure units 38 and **38*a*, each of them comprising four pressure gas containers 42, which can be constituted by so-called standard gas bottles as in FIG. 1, and four liquid containers 44. A common outlet line 39 can be connected for instance to a number of fire zones in a sprinkler system, to a number of fire zones on car deck, and to a number of fire zones in the engine room and cargo hold. The common outgoing gas line of low-pressure pumps 50 of the drive units 38 and 38*a* is connected to corresponding fire zones in the engine room and cargo hold in principle in the same way as shown in FIG. 1**.

The embodiment according to FIG. 2 works essentially in the same way as the embodiment of FIG. 1. The initial stage with delayed liquid delivery occurs in the same way as in FIG. 1, with the same combination of valve 45, liquid cylinder 46, throttle 47, and overflow valve 63, and subsequently, the units 38 and **38*a*, respectively, are emptied of liquid alternatingly one after the other or simultaneously, if necessary, and the propellent gas being left over after the emptying continues driving the corresponding pumps 50. The number of gas containers 42 and water containers 44** connected in each case may be varied as desired. For instance, a gas bottle together with four water bottles can be used for sprinkler systems and two gas bottles together with four water bottles can be used for engine rooms, etc.

The drive unit 38, which is supposed to be the first to be activated, comprises a separate pressure gas container 64, which can be connected to the pump 50 via a pressure reducing valve adjusted, e.g., for 6 bar, in order to maintain preferably a low liquid pressure in the sprinkler system during the activated state of the equipment. When there is a flow in some part of the sprinkler system, a flow indicator 65 generates a Signal in a corresponding section valve 66, upon which signal the drive units are activated.

I claim:

1. A method for fighting fire, the method comprising:

delivering extinguishing liquid to at least one spray head or sprinkler (5–7) by a drive unit (8) comprising at least one hydraulic accumulator (12–14) comprising at least one pressure gas container (12, 13) containing a propellent gas chargeable up to a high initial pressure and a liquid container (14) containing the extinguishing liquid, and a low-pressure water pump (19, 20), wherein a remaining portion of the propellent gas is left over after the hydraulic accumulator has been emptied of the extinguishing liquid;

driving the low-pressure pump utilizing at least part of the remaining portion of the propellent gas;

initially delaying said delivering when the drive unit is switched on;

during said delaying initially driving the low-pressure pump utilizing gas; and delivering cooling liquid to a pipe system (10) and to said spray head or sprinkler by said initially driving;

wherein said driving utilizing said part of the remaining portion of the propellent gas comprises redriving the low-pressure pump.

2. A method according to claim 1, wherein said drive unit further comprises an outlet line (9) for the hydraulic accumulator, a valve (15) in the outlet line including a spindle (26) having a first surface in fluid communication with the hydraulic accumulator to open the valve in the outlet line and a second surface to close the valve in the outlet line, and a cylinder (16) containing a liquid (25) in fluid communication with the second surface of the spindle and connected to the outlet line through a throttle (17), the second surface being larger than the first surface by a proportion; and wherein said delaying comprises leading the propellent gas of said at least one hydraulic accumulator to empty the liquid cylinder, driving the liquid out of the cylinder at a pressure and through the throttle, applying the cylinder liquid pressure to the second surface of the spindle to close the valve in the outlet line, creating an outgoing liquid pressure of said at least one hydraulic accumulator, applying the outgoing liquid pressure to the first surface of the spindle to strive to open the valve in the outlet line, and opening the valve in the outlet line only when all of the cylinder liquid has been driven out and the cylinder liquid pressure has sunk over the throttle to a level which is lower than the outgoing liquid pressure in a proportion equal to the proportion between the spindle surfaces.

3. A method according to claimed, further comprising upon said opening, allowing the cylinder liquid pressure to sink to a predeterminable value, for adjusting a pressure at which the valve in the outlet line is closed again.

4. A method according to claim 1, wherein said initially driving utilizes the propellent gas.

5. A method according to claim 1, wherein said initially driving utilizes gas from a separate source.

6. A method according to claim 1, wherein said fire is in an engine room (1) of a ship having a bilge space (3), and wherein the method further comprises at least during the delaying and during the redriving, leading the propellent gas from said at least one hydraulic accumulator into the bilge space.

7. A method of fighting a fire, the method comprising:

first driving a first fire-extinguishing liquid from at least one spray head or sprinkler (5, 6, 7) at a fire with a low-pressure pump (19, 20);

thereafter driving a second fire-extinguishing liquid from a liquid container (14) and the spray head or sprinkler at the fire with a first propellant gas from at least one gas container (12, 13), at least some of the first propellent gas remaining in the gas container after all of the second fire-extinguishing liquid has been driven from the liquid container;

still thereafter again driving the first fire-extinguishing liquid from the spray head or sprinkler at the fire with the low-pressure pump, the low-pressure pump being driven by the first propellant gas that was remaining in the gas container.

8. The method according to claim 7, wherein the low-pressure pump is driven by the first propellent gas during the first driving.

9. The method according to claim 7, wherein the low-pressure pump is driven by a second propellent gas during the first driving.

10. The method according to claim 7, wherein the fire is in an engine room of a ship having a bilge, and wherein the first propellent gas is fire extinguishing, and wherein the method further comprises providing the first propellent gas to the bilge at least during the first and again drivings.

* * * * *